United States Patent [19]

Raptoplous

[11] 4,173,855

[45] Nov. 13, 1979

[54] PREFABRICATED BUILDING FRAME STRUCTURE

[75] Inventor: Harry C. Raptoplous, Bloomfield Hills, Mich.

[73] Assignee: Obezag Design and Development Corporation, Detroit, Mich.

[21] Appl. No.: 807,097

[22] Filed: Jun. 16, 1977

[51] Int. Cl.[2] ..... E04B 7/00

[52] U.S. Cl. ..... 52/82; 52/236.1

[58] Field of Search ..... 52/82, 79.4, 236.1, 52/236.2, 126, 15, 460, 463, 667, 729, 666, 668, 79.5, 79.1, 238, 365, 264, 346, 345

[56] References Cited

U.S. PATENT DOCUMENTS

| | | | |
|---|---|---|---|
| 2,715,953 | 8/1955 | Marrow | 52/236.2 |
| 3,149,436 | 9/1964 | Varlonga | 52/460 |
| 3,477,187 | 11/1969 | Fruman | 52/346 |
| 3,633,325 | 1/1972 | Bartoli | 52/82 |
| 3,640,036 | 2/1972 | Nakazawa | 52/126 |
| 3,827,200 | 8/1974 | Preissler | 52/82 |
| 3,899,857 | 8/1975 | Mochizuki | 52/126 |
| 3,925,952 | 12/1975 | Hagel | 52/264 |

FOREIGN PATENT DOCUMENTS

| | | | |
|---|---|---|---|
| 71023 | 12/1916 | Austria | 52/463 |
| 2601850 | 7/1977 | Fed. Rep. of Germany | 52/79.1 |
| 1017902 | 12/1952 | France | 52/236.2 |
| 1308023 | 9/1962 | France | 52/82 |
| 581193 | 10/1946 | United Kingdom | 52/236.1 |
| 590294 | 4/1947 | United Kingdom | 52/82 |
| 593133 | 10/1947 | United Kingdom | 52/264 |
| 858150 | 1/1961 | United Kingdom | 52/87 |

*Primary Examiner*—Price C. Faw, Jr.
*Assistant Examiner*—H. E. Raduazo
*Attorney, Agent, or Firm*—Harness, Dickey & Pierce

[57] ABSTRACT

The prefabricated building frame structure or gazebo is of octagonal configuration and has a centrally located vertical axis. It includes a structural support system, a floor system carried by the support system above ground level, and a roof system carried solely by the support system. The floor and roof systems are provided with collars, each with at least three sides, which are spaced apart and are located on the vertical axis. The structural support system includes at least three vertical support columns with each column being spaced an equal distance from the axis and being spaced equal distances from adjacent columns to form the octagonal configuration. The floor system includes joists of equal length, one for each collar side and corresponding column. The joists extend from the floor collar to the support columns. The sides of the roof collar and the upper end portions of the support columns are provided with fastening brackets. The roof system includes rafters of equal length one for each side of the roof collar and corresponding support column.

17 Claims, 14 Drawing Figures

FIG.12
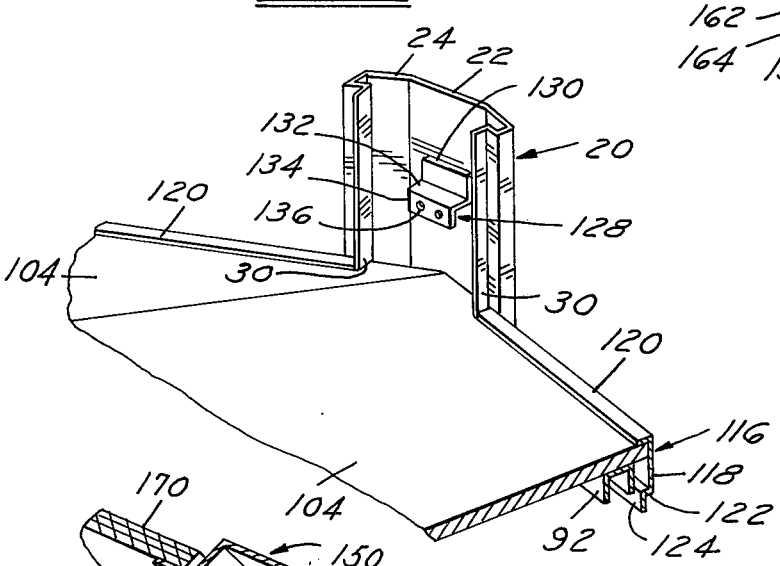
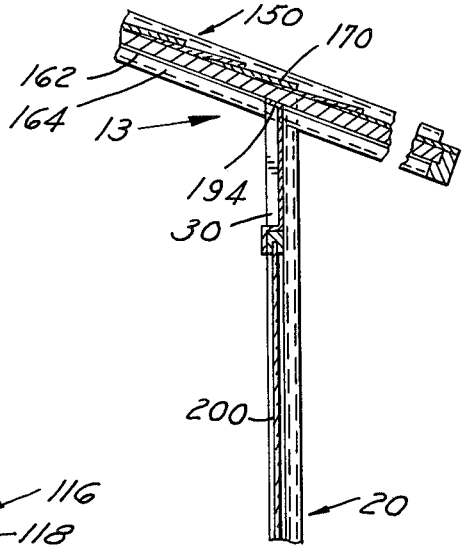
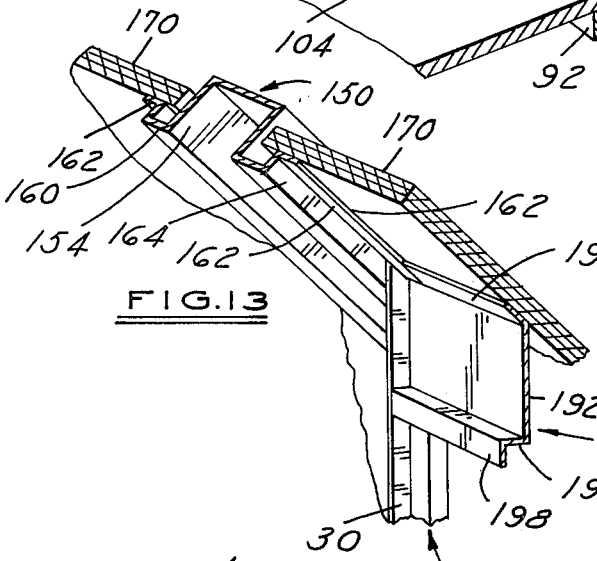
FIG.13
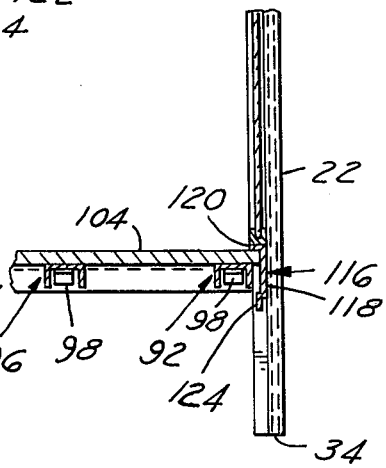
FIG.11
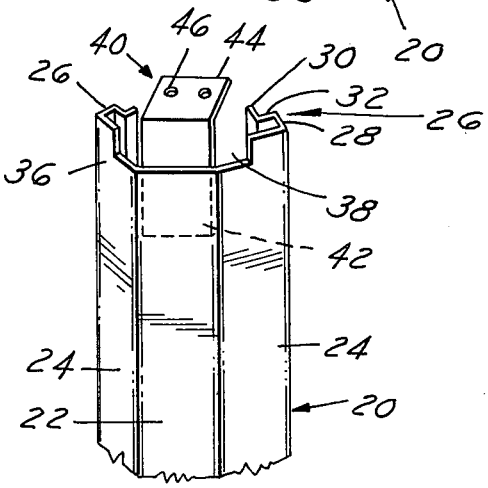
FIG.14

PREFABRICATED BUILDING FRAME STRUCTURE

BACKGROUND OF THE PRESENT INVENTION

1. Field of the Invention

The prefabricated building frame structure or gazebo consists of a predetermined number of manufactured structural columns, collars, floor, roof and side closure panels and mechanical fasteners and related elements which may be transported in a knock down or unassembled condition and assembled or erected at the site. The interior of the gazebo may be used for different and multiple purposes such as for enclosing a bar with suitable plumbing, kitchen equipment, showers or the like. The gazebo is a multiple purpose unit which can be used at shopping centers, country clubs, swimming pools, tennis courts and residential and commercial areas for business, social and other functions.

2. Description of the Prior Art

There are available portable and/or prefabricated building frame structures such as gazebos which consist of prefabricated components which can be readily assembled and disassembled and used for different purposes.

SUMMARY OF THE PRESENT INVENTION

It is a feature of the present invention to provide a prefabricated building structure of octagonal configuration having a centrally located vertical axis and having a structural support system, a floor system, and a roof system. With such a construction the floor and roof systems are provided with collars, each with eight sides, which are spaced vertically apart and are located on the vertical axis.

A further feature of the present invention is to provide a structure of the aforementioned type wherein the structural support system includes eight vertical support columns of equal length and of generally identical configuration, each column being spaced an equal distance from the axis and collars and being spaced equal distances from adjacent columns to form the octagonal configuration.

A still further feature of the present invention is to provide a structure of the aforementioned type wherein the sides of the floor collar and the support columns are provided with upwardly opening clips, with the floor system including joists of equal length, one for each collar side and column. With such a construction the joists extend horizontally from the floor collar to the support columns and are provided with downwardly extending locking flanges at the ends thereof which are interlocked with and are carried by the clips.

Another feature of the present invention is to provide a structure of the aforementioned type wherein the sides of the roof collar and the upper end portions of the support columns are provided with fastening brackets, with the roof system including rafters of equal length, one for each side of the roof collar and corresponding support column. With such a construction, the rafters extend from the roof collar in a downwardly direction towards the support columns and include end portions abutting and overhanging the support columns. Fastening devices secure the rafters near each end thereof to the roof collar and support columns.

Still another feature of the present invention is to provide a structure of the aforementioned type wherein the floor system includes one or more cross braces secured to adjacent joists by means of angle clips welded to the joists and floor panels carried by the joists and braces in edge abutting relationship.

A further feature of the present invention is to provide downwardly extending skirts, each skirt located between and abutting each pair of adjacent support columns, for enclosing the exposed edges of the floor panels and for enclosing the joists and braces.

A still further feature of the present invention is to provide a center support for the floor system including a plate provided on the bottom of the floor collar having an opening therein and a nut secured to the bottom of the plate. An axially extending ground engaging threaded support rod is threaded to the nut and provides additional support for the floor system.

Another feature of the present invention is to provide a structure of the aforementioned type wherein the upper end portion of each column is notched to permit the corresponding rafter to be seated therein and carried thereby.

Still another feature of the present invention is to provide a structure of the aforementioned type wherein the components thereof are easy to assemble and disassemble and the resulting structure is efficient in operation, easy to maintain, attractive, and is provided with sufficient useable space or volume suitable for multiple purposes and functions.

BRIEF DESCRIPTION OF THE DRAWINGS

FIG. 11 is a fragmentary vertical sectional view of the structure, taken on the line 11—11 of FIG. 2;

FIG. 12 is a fragmentary sectional view of the column and floor system, taken on the line 12—12 of FIG. 1;

FIG. 13 is a fragmentary perspective view of the roof system looking in the direction of arrow 13 of FIG. 11; and FIG. 14 is a fragmentary perspective view of a support column.

DESCRIPTION OF A PREFERRED EMBODIMENT

Figure 1:
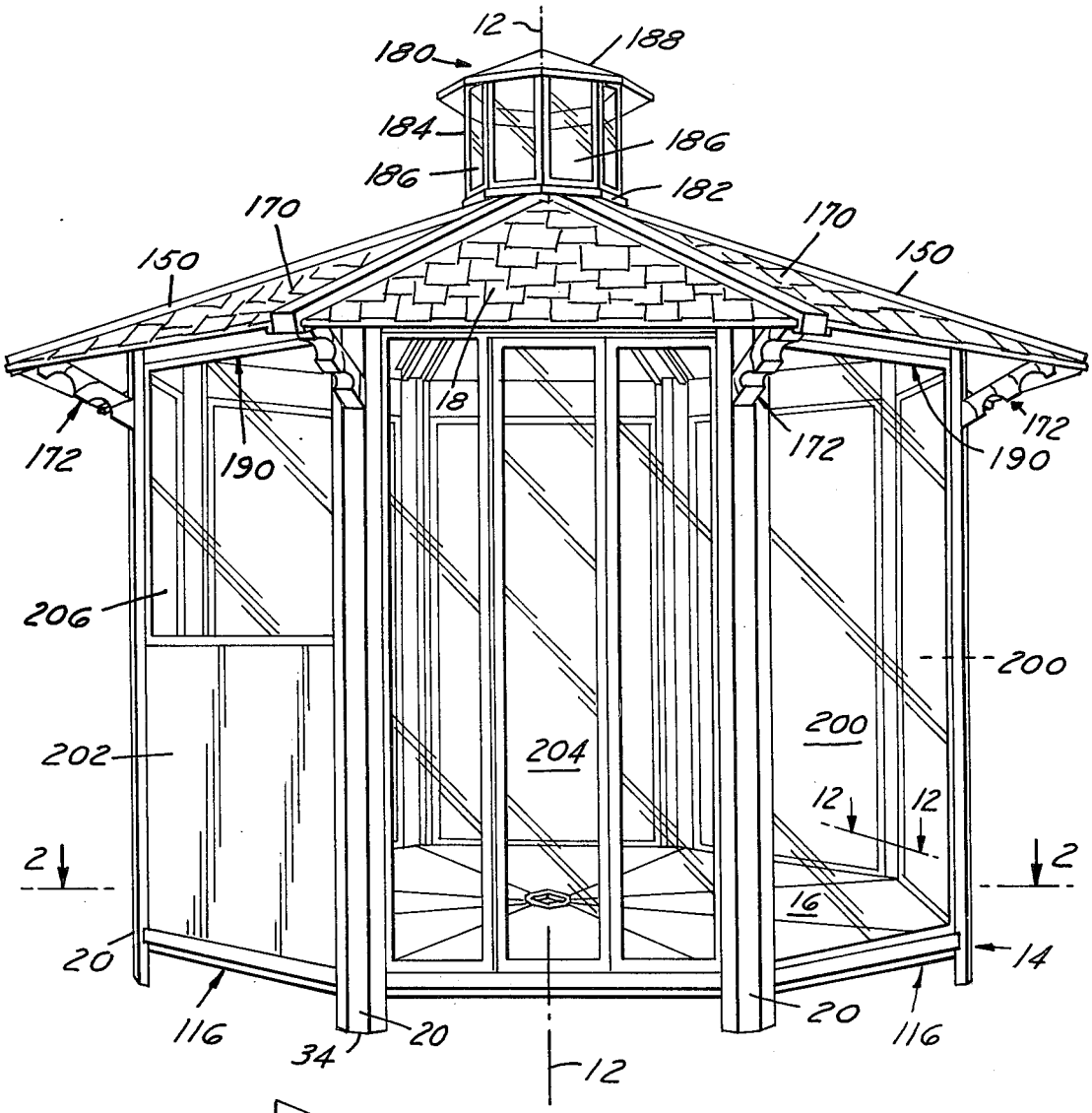
FIG. 1 is a perspective view of the gazebo.

The prefabricated building frame structure or gazebo is designated by the numeral 10 (FIG. 1), is of octagonal configuration, and has a centrally located axis 12. The gazebo 10 consists of a structural column support system 14, a floor system 16 carried by the structural support system 14 above ground level, and a roof system 18 carried by the structural support system 14.

The structural support system 14 includes eight vertical elongated support columns 20 of equal length and generally of identical trough shape configuration as illustrated in FIG. 14. Each column 20, as shown in FIG. 1, is spaced an equal distance from the axis 12 and is spaced equal distances from adjacent columns 20 to form the octagonal configuration.

Each structural column 20 includes a flat center section 22 and a pair of flat outer sections 24 which are inwardly turned in the same direction generally towards the axis 12 to form a trough. Each outer section 22 has on the longitudinal edge thereof a generally Z-shape extension 26 consisting of a pair of generally parallel flanges 28 and 30 which are connected by a perpendicularly arranged flange portion 32 which is parallel to and spaced from the corresponding outer section 24. The column flanges 30 each extend in a direction generally towards the axis 12.

The bottom end or surface 34 of each column 20 is flat and rests on the ground or other supporting area. The upper end portion 36 (FIG. 14) is provided with a notch 38 to form a seat for the roof rafter to be subsequently described. The notch 38 extends through the flat center section 22 and partially through adjacent areas of the outer sections 24 as shown in FIG. 14. Each column 20 has an angle or bracket or other fastening element 40 welded thereon adjacent the notched area or zone 38. Bracket 40 includes a mounting or first flange 42 welded to center section 22 and an integral angularly related mounting or second flange 44 provided with two holes of openings 46.

The floor system 16 includes a floor collar 50 having eight sides 52 and arranged on the axis 12. The collar 50 is made from channel shape elements (FIG. 3) welded together to form the sides 52, a continuous top flange 54 and a continuous bottom flange 56. A bottom plate 58 is welded or otherwise secured to the bottom side of flange 56 and is provided with a centrally located non-threaded opening 60 having an axis coinciding with axis 12. A threaded nut 62 is secured or welded to the bottom of plate 58 concentric with axis 12. An elongated threaded support rod 64 having a ground engaging load distribution base 66 is threaded to the nut 62 (FIG. 3) and provides additional support for the floor system 16 at the center of the structure beneath the collar 50.

Each of the eight sides 52 of collar 54 is provided with a clip 70 of generally Z-shape configuration including a flange 72 welded or secured to side 52, an intermediate offset portion 74, and a flange 76 spaced from side 52 to form a locking space. Thus collar 50 eight clips 70.

Figure 3:
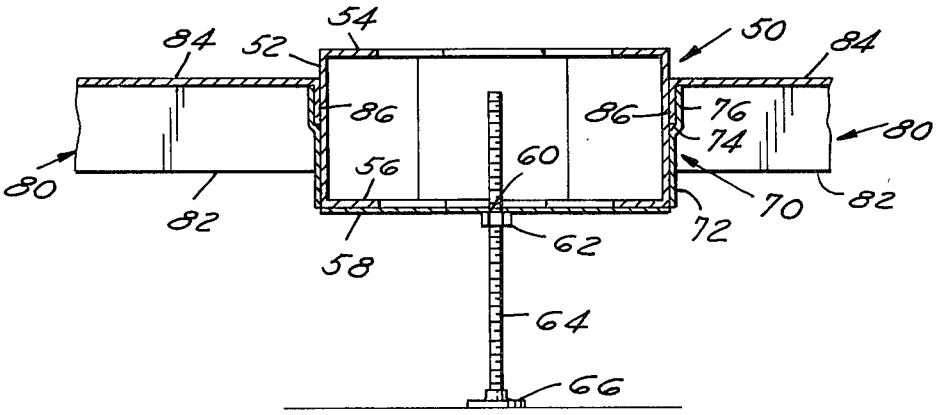
FIG. 3 is a sectional view through the floor collar and joints, taken on the line 3—3 of FIG. 2.
Figure 5:
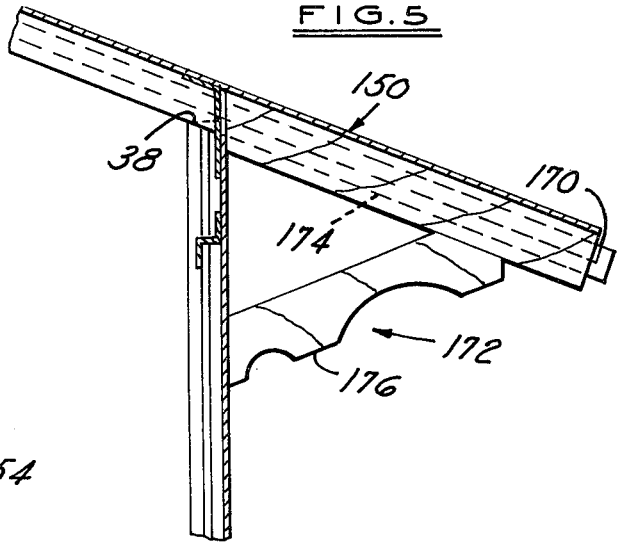
FIG. 5 is a fragmentary elevational view of the gazebo, partly in section.

The floor system 16 includes eight floor joists 80, each of channel shape configuration, having a pair of downwardly extending side flanges 82 and web or base 84. The ends of each joist 80 is provided with a downwardly extending collar flange 86 (FIG. 3) and a column flange 88. Each collar flange 86 fits into the locking space in the corresponding clip 70 and abut the corresponding side 52 and flange 76 (FIG. 3). Each column 20 is provided on the bottom end portion thereof with a clip 90 of generally Z-shape configuration like clip 70 aforesaid. The column flange 88 on each joist 80 fits into the space between the corresponding clip 90 and column 24 as shown in FIG. 5. Thus each end of each joist 80 has a downwardly extending flange which is received in and locked by a clip carried by the collar 50 and corresponding column 20.

Figure 2:
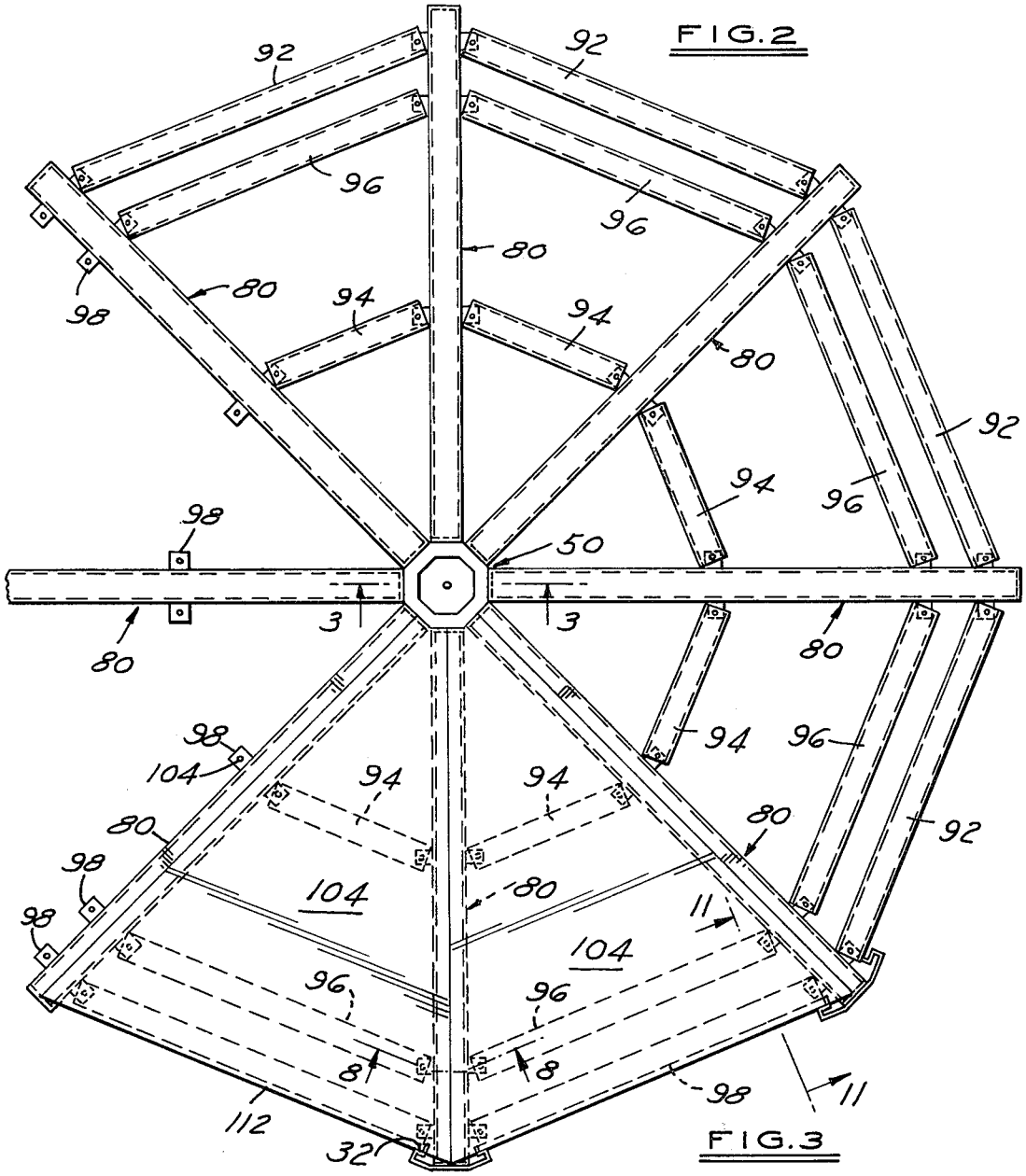
FIG. 2 is a plan view of the floor system, taken on the line 2—2 of FIG. 1, with certain floor panels removed.
Figure 8:
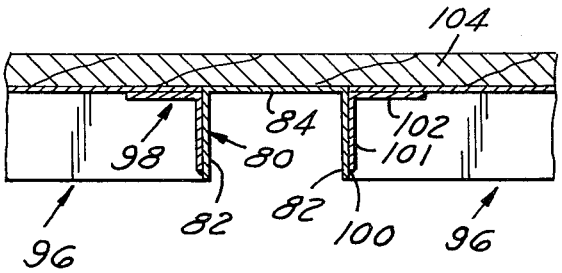
FIG. 8 is a sectional view through a joist and floor panels taken on the line 8—8 of FIG. 2.

As shown in FIG. 2, each pair of adjacent joists 80 extending generally radially from axis 12 and are connected at the outer ends thereof by a first cross brace 92, at the mid points thereof by a second cross brace 94, and by a third cross brace 96 which is located closest to brace 92 than to brace 94. Brace 92 is longer than brace 96 which is longer than brace 94. Each brace 92, 94, 96 has a channel shape configuration as shown in part by FIG. 11. Each joist 80 has secured along each flange 82 thereof three longitudinally spaced right angle clips 98. The vertical flange 101 of each clip is welded to the flange 82 as shown by the numeral 100 in FIG. 8. The horizontal flange 102 of each clip 98 has an opening 104 whereby the end portion of a cross brace may be secured to the corresponding joists by means of threaded fastening elements or devices, not shown, as represented by FIGS. 8 and 11.

Figure 4:
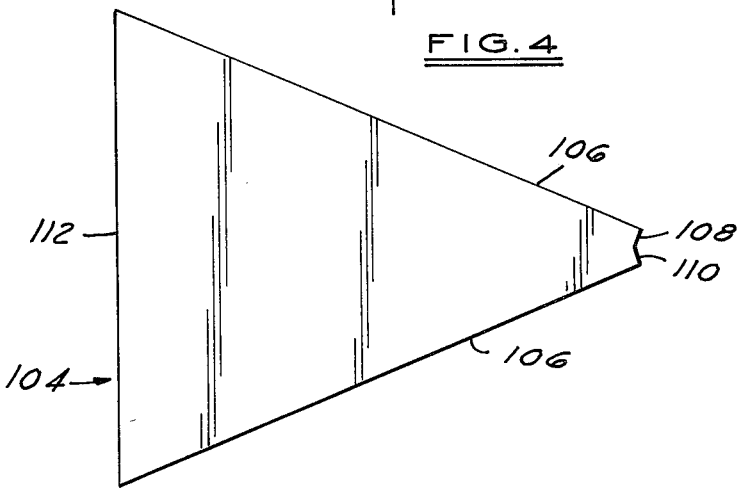
FIG. 4 is a plan view of one of the floor panels shwon in FIGS. 1 and 2.
Figure 6:
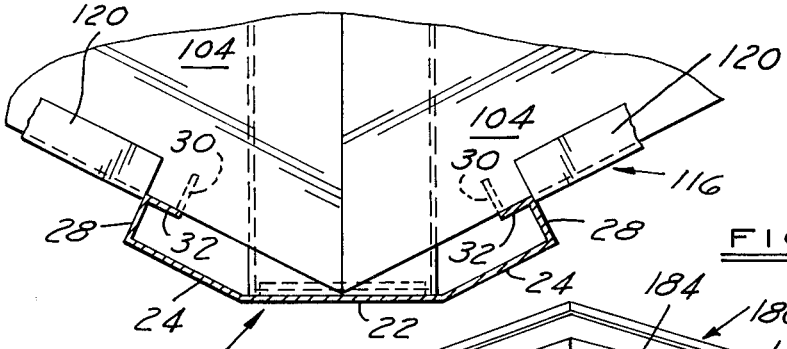
FIG. 6 is a sectional view taken on the line 6—6 of FIG. 5 and showing structural features of the floor system.

The floor system 16 further includes, as an example, eight floor panels 104 of generally triangular configuration (FIG. 4). Each panel is of uniform thickness and is made from plywood or other suitable material. Each panel 104 has a pair of converging side edges 106 intersecting at a corner or peak having a pair of intersecting edge surfaces or notches 108, 110. The other ends of edges 106 intersect the base edge 112 (FIG. 4). The floor panels 104 are placed on top of the joists 80 and cross braces 92, 94 and 96 usually without any mechanical fastening devices therebetween. The notch edges 108, 110 of each floor panel 104 engage a corner of the collar 50 formed by a pair of adjacent sides 52. The base edge 112 of each floor panel 104 has abutments, surfaces or areas thereof which engage and abut column flange portion 32 and center section 22 as shown in FIGS. 2, 6 and 12. The edges 106 of adjacent floor panels 104 abut and the peaks thereof fit snugly within the interior of the columns 20 as shown in FIGS. 6 and 12. The top surface of the floor collar 50 is flat and flush with the top surfaces of the floor panels 104.

In order to cover or to enclose the edges 112 of the floor panels 104 and the joists and cross braces, a downwardly extending elongated skirt 116 is provided between each pair of adjacent columns 20. Each skirt 116 has a generally vertical flange portion 118 having on the upper end thereof, an inwardly turned lip or flange portion 120 which engages the top surface of floor panel 104 at the outer periphery thereof. The lower end of flange portion 118 has a horizontal ledge portion 122 terminating in a downwardly extending rim portion 124. Each skirt 116 has a length equal to the distance between the flanges 30 of adjacent columns 20. The skirt fits into the space therebetween thus abutting flanges 30. No mechanical fastening devices are thus required to mount and to install skirts 116.

Each column 20 is provided with a plurality of angle bracket 128 on the inner surface of the center section 22 between the joist clip 90 (FIG. 5) and the rafter clip 40 (FIG. 14). As an example, five such clips or brackets 128 may be provided on each column spaced, as an example, equal distances apart. Each bracket 128 has a flange 130 welded to center section 22, an integral horizontal portion 132 terminating in a flange 134 provided with a pair of bolt openings 136. The brackets 128 may be used to mount various interior wall panels or equipment etc. as required in the interior of the gazebo 10.

Figure 9:
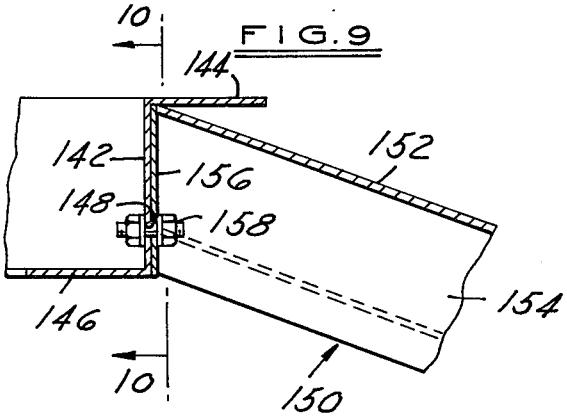
FIG. 9 is a sectional view through a roof rafter taken on the line 9—9 of FIG. 7.
Figure 9:
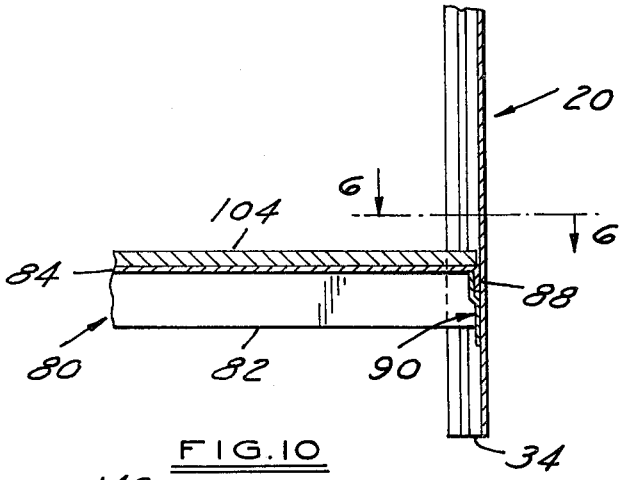
Figure 10:
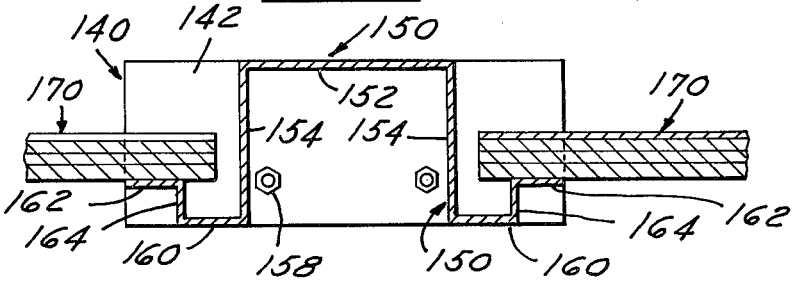
FIG. 10 is a sectional view of a roof rafter and corresponding roof panels taken on the line 10—10 of FIG. 9.

The roof system 18 includes a roof collar 140 of octagonal configuration having eight flat sides 142, a top flange 144 and a lower flange 146 as shown in FIGS. 9 and 10. Each side 142 has a pair of bolt openings 148 (FIG. 9) for mounting a roof rafter 150. The collar 140 is mounted directly above floor collar 50 and has the same axis 12.

Each roof rafter 150 has a center web or section 152 terminating in a pair of downwardly extending flanges 154. The upper end of each rafter 150 is provided with a mounting flange 156 having a pair of bolt openings. Flange 156 abuts the corresponding collar side 142 and si secured thereto by a pair of nut and bolt assemblies 158 as shown in FIGS. 9 and 10.

Each rafter 150 includes on each of the edges of flanges 150, a Z-extension including a pair of parallel portions 160 and 162 which are connected by a perpendicularly arranged connecting element 164.

Figure 7:
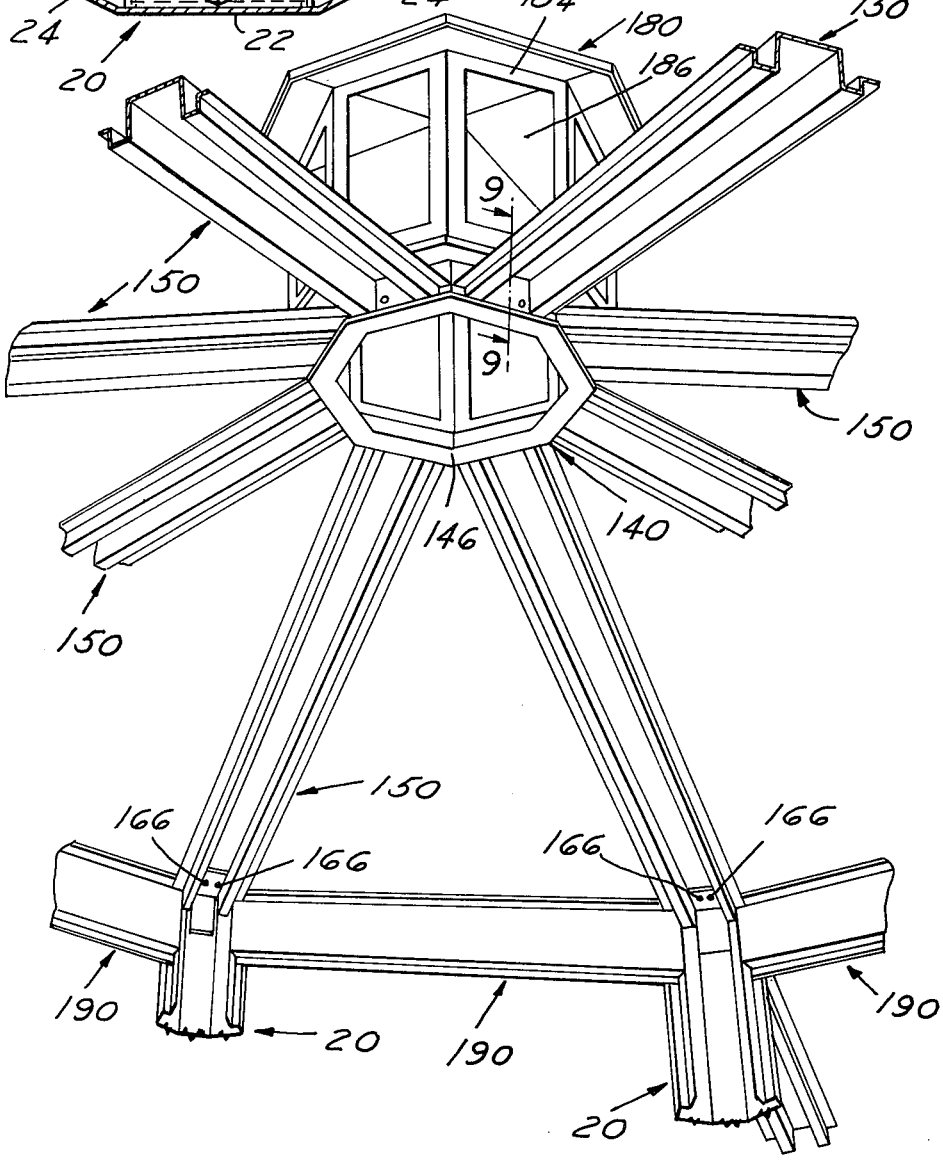
FIG. 7 is a perspective view of the roof system of the gazebo and its connection to the structural columns.

The rafter 150 extend downwardly from collar 140 and axis 12 towards the upper end portions of columns 20 where end portions of the rafters 150 extend beyond columns 20 and are seated in the notched zones or areas 38 of the columns 20. The rafters 150 are secured to the columns 20 by means of threaded nut and bolt assemblies 166 (FIG. 7) which extend through the openings 46 provided in column clips 40 and the openings provided in the center webs 152 of rafters 150.

The roof system 18 further includes roof panels 170 of generally triangular configuration. Each panel 170 fits between a pair of adjacent rafters 150 and are supported by the parallel rafter portions 162 as shown in FIG. 10. The roof panels 170 may be suitably connected to the portions 162 of rafters 150 by suitable fastening devices, not shown. The panels 170 may be made from plywood, wood or cedar shingles carried by roofing paper etc.

A cosmetic bracket assembly 172 is provided for each rafter 150 and comprises a pair of angularly related elements 174 and 176. Element 174 fits into the channel portion of rafter 150 exteriorly of the structure 10 and is bolted or secured thereto. Element 176 abuts and is appropriately secured to column 20 as shown in FIG. 5.

A bonnet assembly 180 is mounted on the structure 10 and is of octagonal configuration. It includes a rim portion 182 which is secured to the roof collar 140; upstanding frames 184 of octagonal configuration provided with window panels 186 made from glass or a transparent material; and a hat or cover 188 enclosing the assembly 180. The axis 12 extends through the center of the assembly 180.

The upper portion of the structural column system 16 is provided with eight elongated connecting elements or headers 190. Each header 190 includes a vertical section 192 terminating in an upper lip 194 which engages the roof panel 170 (FIG. 13). The lower edge portion of section 192 terminates in a horizontal section 196 having a vertical flange 198. Each header 190 fits snugly between and abuts the parallel flanges 30 provided on adjacent columns 20 and is secured thereto by fastening devices, not shown.

Each pair of adjacent columns 20 along with the header 190 therebetween form a frame in which may be inserted panels, windows, doors etc. to enclose the interior of the structure 10. As an example, such panels may consist of a plurality of glass panels 200, a solid panel 202 of wood or plastic, a door panel 204, a glass and screen panel 206 etc. The types of panels utilized may depend upon the purpose for which the structure is used. Each panel is secured across the top and sides thereof to the header 190 and columns 20 by appropriate fastening devices, not shown. As an alternate wood or cedar shingle panels may be used to enclose the structure 10.

What is claimed is:

1. A prefabricated building frame structure of octagonal configuration and having a centrally located vertical axis, said frame structure comprising a structural support system, said structural support system consisting essentially of eight vertical support columns of equal length and of generally identical configuration, each column being spaced an equal distance from said axis and being spaced equal distances from adjacent columns to form the octagonal configuration, the upper end portion of each of said support columns being notched to form a recess, a floor system carried by said support system above ground level, and a roof system carried solely by said eight vertical support columns of said support system, said floor and roof systems having collars, each with eight sides, said collars being vertically spaced apart and located on said vertical axis, the sides of said floor collar and said support columns having upwardly opening clips secured thereto, said floor system including joists of equal length, one for each collar side and corresponding column, said joists extending horizontally from said floor collar to said support columns, said joists being provided with downwardly extending locking flanges at the ends thereof which are interlocked with and carried by said upwardly opening clips, the sides of said roof collar and the upper end portions of said support columns being provided with fastening brackets, said roof system including rafters of equal length one for each side of the roof collar and corresponding support column, each of said rafters extending from said roof collar in a downwardly direction towards the corresponding support column and including an end portion seated in the recess and overhanging the support column, and mechanical fastening devices for securing said rafters to the brackets of said roof collar and to the brackets of said support columns.

2. A prefabricated building frame structure as defined in claim 1 wherein said floor system includes three cross braces between adjacent joists, each of said braces being secured to adjacent joists by means of angle clips welded to the joists, each clip having a horizontal support flange, the end portions of each brace overlying the support flanges of opposing clips and being secured thereto by mechanical fastening devices, each cross brace being of a different length, one cross brace being located at the outer end portions of adjacent joists near the corresponding support columns, the second brace being located generally near the mid portions of adjacent joists, and the third brace being located between the first and second braces but closer to said first brace than said second brace.

3. A prefabricated building frame structure defining an enclosure of polygonal configuration and adapted to set on a surface and having a centrally located vertical axis, said frame structure comprising:

a structural support system including at least three vertical support columns of equal length, said columns having lower end portions adapted to rest on such surface, each column being spaced an equal distance from said axis and being spaced equal distances from adjacent columns to form the polygonal configuration; characterized by the combination which includes a floor system carried by said support system above the level of said surface, including a rigid floor collar located on said vertical axis and joists of equal length extending radially between and tied both to said floor collar and to said support columns, a plurality of connecting header elements extending entirely around the polygonal configuration defined by said columns, at least one of said header elements extending between and being secured to an upper portion of each pair of adjacent columns; and a roof system carried solely by said vertical support columns of said support system, comprising a rigid roof collar located on said vertical axis at a position higher than the tops of said columns, a plurality of rafters of equal length and corresponding in number to the number of said vertical support columns, each of said rafters being inclined upwardly from the columns to the roof collar and secured both to the roof collar and to an upper end of one of said columns, said rafters and roof collar constituting, with the exception of the floor system, the sole structural interconnection between the columns extending transversely with respect to said enclosure and also the sole structural interconnection between the header elements extending transversely with respect to said enclosure.

4. The prefabricated building frame structure defined in claim 3 wherein said floor system includes one or more cross braces between adjacent joists, each of said braces being secured to adjacent joists by means of angle clips welded to the joists, each clip having a horizontal support flange, the end portions of each brace overlying the support flanges of opposing clips and being secured thereto by mechanical fastening devices.

5. The prefabricated building frame structure defined in claim 4 wherein there are three cross braces between adjacent pairs of joists, each cross brace being of a different length.

6. The prefabricated building frame structure defined in claim 4 wherein floor panels having side edges are located on and carried by said joists and said braces, said floor panels extending from said floor collar to said support columns, with the side edges of each of said floor panels abutting the side edges of adjacent floor panels.

7. The prefabricated building frame structure of claim 6 wherein a downwardly extending skirt is provided between and abuts each pair of adjacent support columns and includes a flange portion overlying the top surface of the adjacent floor panel.

8. The prefabricated building frame structure of claim 6 wherein the top surface provided on said floor collar is flush with the top surfaces of said floor panels.

9. The prefabricated building frame structure of claim 6 wherein said floor collar is provided with a bottom plate having an opening therein concentric with said axis, a nut concentric with said axis secured to the lower surface of said bottom plate, and an axially extending ground engaging threaded support rod threaded to said nut for providing additional support for the floor system.

10. The prefabricated building frame structure defined in claim 3 wherein each support column is provided with a plurality of vertically spaced angle brackets, each angle bracket having a pair of oppositely turned flanges at opposite edges of a generally horizontal portion, one flange of each bracket being secured to the support column, with the other flange provided with one or more openings for receiving mechanical fastening devices when attaching a side panel between a pair of adjacent support columns.

11. The prefabricated building frame structure of claim 3 wherein the upper end portion of each column is notched to permit the corresponding rafter to be seated therein and carried thereby.

12. The prefabricated building frame structure of claim 11 wherein each rafter includes a downwardly turned channel provided at each of the lower edges thereof with a Z-shape extension adapted to support a roof panel.

13. The prefabricated building frame structure of claim 6 wherein said floor panels are provided with edge abutments which engage said support columns.

14. The prefabricated building frame structure of claim 6 wherein a downwardly extending skirt is provided between and abuts each pair of adjacent support columns and includes a flange portion overlying the top surface of the adjacent floor panel.

15. The prefabricated building frame structure of claim 6 wherein the top surface provided on said floor collar is flush with the top surfaces of said floor panels.

16. The prefabricated building frame structure of claim 4 wherein said joists and said braces are made from steel of channel shape configuration, with the side flanges of each of said joists and braces extending downwardly.

17. A building frame structure as defined in claim 3 including central supporting means adjustably secured to and extending downwardly from the floor collar and adapted to bear against the surface, said central supporting means being located entirely below the floor level.

* * * * *